United States Patent [19]

Carlson et al.

[11] Patent Number: 5,015,921

[45] Date of Patent: May 14, 1991

[54] SOFT START SOLID STATE SWITCH

[75] Inventors: Peter J. Carlson; Robert G. Hodgins, both of Raleigh, N.C.

[73] Assignee: General Electric Company, Somerville, N.J.

[21] Appl. No.: 163,534

[22] Filed: Mar. 17, 1988

[51] Int. Cl.[5] ..... H05B 37/00; G05F 1/00; H01D 5/12

[52] U.S. Cl. ..... 315/208; 315/307; 315/311; 315/DIG. 7; 330/134

[58] Field of Search ..... 315/208, 307, 311, DIG. 7; 372/38; 330/134

[56] References Cited

U.S. PATENT DOCUMENTS

| | | | |
|---|---|---|---|
| 3,441,866 | 5/1967 | Barber et al. | 330/29 |
| 3,898,516 | 8/1975 | Nakasone | 315/208 |
| 3,938,000 | 2/1976 | Higashicle | 315/208 |
| 4,009,385 | 2/1977 | Sell | 372/38 |
| 4,115,828 | 9/1978 | Rowe et al. | 372/38 |
| 4,395,661 | 7/1983 | Becker | 315/208 |
| 4,417,183 | 11/1983 | Popard et al. | 315/311 |
| 4,486,070 | 4/1968 | Engel | 315/225 |
| 4,855,647 | 8/1989 | Schaller et al. | 315/311 |
| 4,855,649 | 8/1989 | Masaki | 315/311 |

*Primary Examiner*—Eugene R. LaRoche
*Assistant Examiner*—Michael B. Shingleton

[57] ABSTRACT

The junction temperature rise of a power MOSFET serially connected to a lamp whose resistance nonlinearly increases during turn-on is moderated by the use of control circuitry which initially sets up a relatively low essentially constant current flow through the lamp and transistor and then automatically after the lamp resistance reaches a preselected level, the lamp is allowed to draw significantly more current. The size and therefore cost of the power MOSFET is reduced significantly because the magnitude of the current spike generated by turning on the lamp is significantly reduced the use of the novel control circuitry.

20 Claims, 6 Drawing Sheets

SOFT START SOLID STATE SWITCH

FIELD OF THE INVENTION

This invention relates to control circuitry for controlling conduction through a load and in particular to circuitry which controls current flow through a semiconductor device thereof which is coupled to an incandescent lamp, a viscous loaded motor or other similar load device whose impedance varies in a nonlinear manner as it turns on.

BACKGROUND OF THE INVENTION

In many applications control circuitry used to control an incandescent lamp or other load which has a nonlinear impedance during turn-on or warm-up comprises a semiconductor device such as a power transistor (e.g., an n-channel Metal-Oxide-Silicon Field Effect Transistor (MOSFET)). A single power n-channel MOSFET can be connected with its drain connected to a power supply having a positive voltage +VDD and its source connected to one terminal of an incandescent lamp. A second terminal of the lamp is connected to ground potential. The gate of the MOSFET is typically coupled through a switch, in many applications a hand operated switch, to a positive voltage source which typically has a potential level of +VDD or in many cases +2VDD. When the switch is turned on the MOSFET is enabled (turned on) and a current path is created from +VDD, through the MOSFET and lamp, and then to ground. The electrical characteristics of an incandescent lamp are such that while the lamp is cold its resistance (the "cold" resistance) is relatively low. As the lamp starts to conduct it heats up and its resistance increases in a nonlinear manner with its "hot" resistance being significantly greater than its "cold" resistance. The MOSFET used must be designed to be able to dissipate a relatively high amount of power as the lamp is turning on since there is a large current spike generated and a significant portion of the voltage of the power supply is across the drain-source of the MOSFET during turn on since the lamp's "cold" resistance is relatively low.

FIG. 1 shows a graph of lamp current in amperes on the y-axis versus time (t) in milliseconds (mS) on the x-axis for a lamp which when fully on and operating in steady state draws about 6 amperes and has a resistance of about 2.25 ohms. Between t=0+ and t=2mS the lamp draws 42 amperes of peak current which decreases such that at about t=40mS a steady state current of 6 amperes is reached. FIG. 2 shows a graph of the junction temperature in degrees C. on the y-axis of a MOSFET in series with the lamp versus time (t) in milliseconds (mS) on the x-axis. The temperature of the junction rapidly increases from 80 degrees C at t=0 to approximately 205 degrees C at t=9mS and then decreases to 95 degrees C by t=40mS. The thermal constant of the MOSFET determines the rate of rise of the temperature thereof The maximum desirable temperature of many MOSFETS is approximately 160 degrees C. Thus under the above described conditions the MOSFET can be damaged. One solution to this problem is to increase the area of the MOSFET such that it can handle 42 amperes of peak current without its temperature exceeding 160 degrees C. This solution is undesirable from an economic view point since a larger area MOSFET requires more silicon and is therefore more expensive to produce.

One prior art solution to the junction temperature problem is to pulse the potential of the gate of the power MOSFET such that it is on for only a short period during each cycle. This limits the average current during a cycle and moderates the temperature rise of the MOSFET. One problem with this technique, which is sometimes denoted PWM (Pulse Width Modulation), is that a plurality of relatively large current spikes are generated which can easily be coupled as noise to other circuits using the same power supply. This is very undesirable in some applications such as in an automobile where turning on of the directional signals could cause multiple loud noises on the radio or tape playing system.

It is desirable to be able to turn on a load whose impedance increases in a nonlinear manner during turn-on using moderate cost control circuitry which includes a power transistor without causing repetitive large noise signals.

SUMMARY OF THE INVENTION

The present invention is directed to circuitry connectable to a load whose impedance nonlinearly increases during turn-on. The circuitry comprises a device (e.g., a power MOSFET) having a control terminal and first and second output terminals, a first biasing means selectively coupled to the control terminal of the device, a second biasing means selectively coupled to the control terminal of the device, and detecting and coupling/decoupling means coupled to the second output terminal of the device. The first biasing means, when coupled to the control terminal of the device, biases on the device so as to facilitate current flow through the device. The second biasing means, when coupled to the control terminal of the device, biases on the device so as to facilitate a flow of current through the device which is greater than that facilitated by the first biasing means. The detecting and coupling/decoupling means effectively detects the impedance of the load and couples the first biasing means to the control terminal of the device and decouples the second biasing means from the control terminal of the device if the impedance of the load is at or below a preselected level. If the impedance of the load is above the preselected level the detecting and coupling/decoupling means couples the second biasing means to the control terminal of the device and decouples the first biasing means from the control terminal of the device.

In one embodiment the first biasing means is an essentially constant current generating means which biases the control terminal of the device such that an essentially constant current flows through the device. In another embodiment the first biasing means is an essentially constant current means which biases the control terminal with an essentially constant current in to the control terminal of the device such that the bias of the control terminal increases with time as does the current flow through the device. In both of the embodiments the second biasing means heavily biases on the device such that it is essentially fully on with its output resistance being as low as can occur.

We have discovered that the magnitude of the current spike generated by the series combination of a transistor and a load whose impedance increases nonlinearly during turn-on can be significantly reduced by first biasing the device such that a relatively low level of current flows there through. The low level of current flow warms up the load (e.g., a lamp) and causes its resistance to increase. After the resistance of the device increases to a preselected level, the biasing is then substantially increased. This allows the load to fully turn-on and to reach its "hot" (high) resistance state which occurs during steady state operation. By reducing the magnitude of the current spike it is feasible to significantly reduce the area of the transistor and thus to reduce the cost of same.

The invention will be better understood from the following more detailed description taken in connection with the accompanying drawing

DETAILED DESCRIPTION

Figure 3:
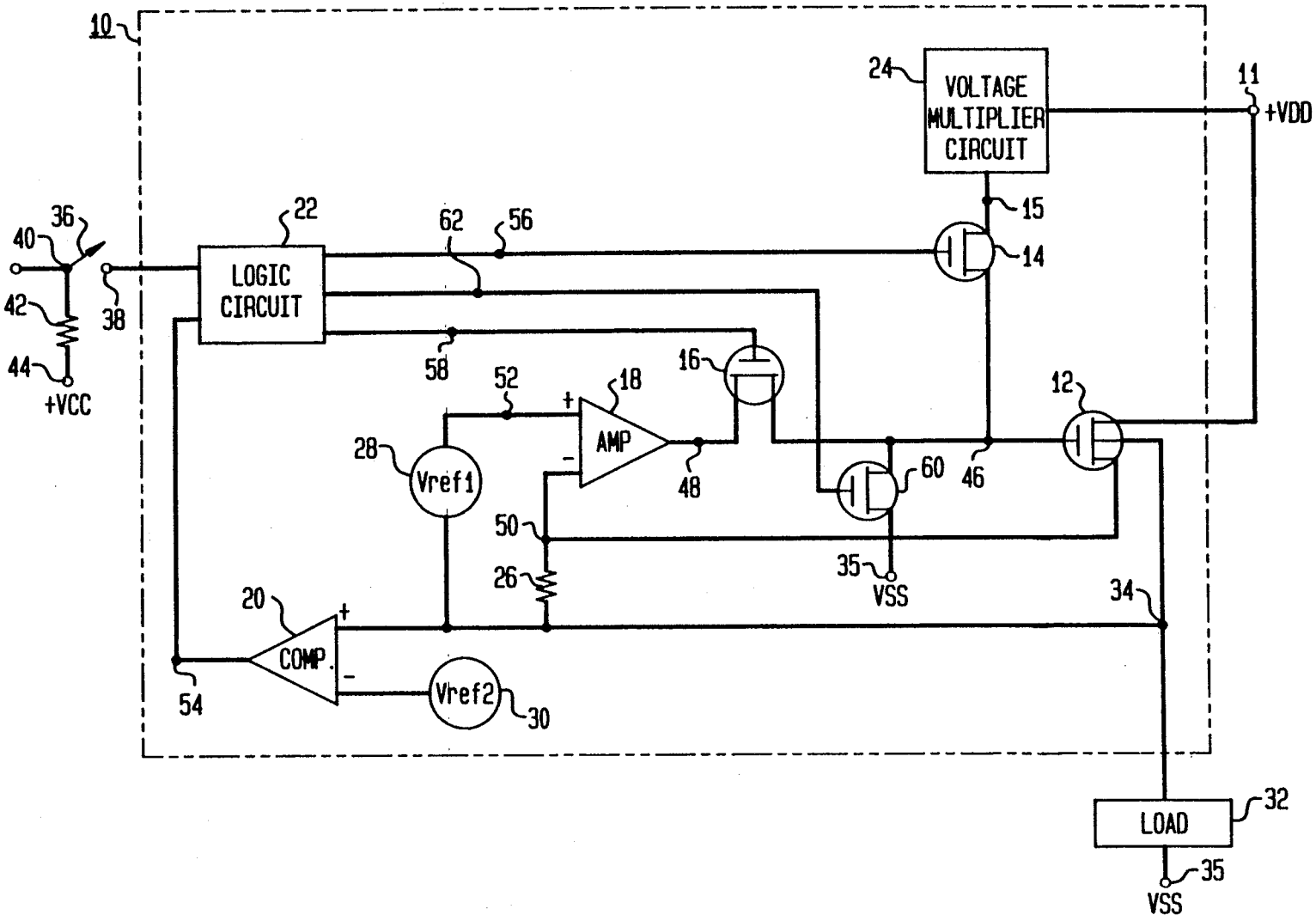
FIG. 3 shows a soft start solid state switch in accordance with one embodiment of the present invention.

Referring now to FIG. 3, there is shown within the dashed line rectangle a soft start solid state switch 10 which comprises an n-channel Metal-Oxide-Silicon Field Effect Transistor (MOSFET) 12 (also denoted as a device) having first and second output terminals comprising the drain and source of the transistor, respectively, n-channel MOSFETs 14, 16 and 60 (also denoted as switching devices), an operational amplifier 18, a two input comparator 20, a logic circuit 22, a voltage multiplier circuit 24, a resistor 26, a first voltage reference source (Vref1) 28 and a second voltage reference source (Vref2) 30. A nonlinear load 32 (e.g., a lamp) is coupled to the second output terminal (source), of transistor 12 and to a terminal 34. The first output terminal (drain) of transistor 12 is connected to the positive terminal VDD of a power supply. A second terminal 35 of load 32 is coupled to a power supply VSS which is typically ground potential A switch 36 is coupled to one input terminal 38 of logic circuit 22. A first terminal of switch 36 is coupled to a first terminal 40 of a resistor 42. A second terminal of resistor 42 is coupled to a power supply +VCC. When switch 36 is closed (the wiper arm thereof connects terminals 36 and 38) soft start solid state switch 10 first allows a relatively low and essentially constant current to flow through load 32. The impedance of load 32 increases as it warms up due to the current flow there through. After the impedance of the load reaches a preselected value, switch 10 acts to allow a substantial increase in the current flow through load 32. Load 32 draws substantially more current until it reaches its "hot" (high impedance level) operating state during which the current flowing there through reaches a steady state level which is substantially lower than the magnitude of the maximum level reached during turn-on.

As will be come clearer from the subsequent description, switch 10 first limits current flow through load 32 to a relatively low essentially constant level. The relatively low essentially constant current flow through the load 32 causes it to warm up and for the impedance thereof to increase Switch 10 senses the impedance of the load 32 as the low level essentially constant current increases the temperature and impedance of load 32 until a preselected level of impedance exists. At this point switch 10 fully biases on transistor 12. The current flow through transistor 12 and load 32 significantly increases and the impedance of load 32 continues to increase until it reaches its "hot" (high) impedance level associated with steady state operation. The initial heating (denoted as preheating) of load 32 by the constant current flowing there through results in an increase in its impedance such that when switch 10 fully biases on transistor, the magnitude of the resulting current spike through load 32 and transistor 12 is substantially lower than would occur if preheating by a constant current was not used. This permits transistor 12 to be a smaller area transistor than is the case if transistor 12 is initially fully biased on and is allowed to draw as much current as its initial "cold" impedance would dictate.

Transistor 12 is typically a large MOSFET which requires a substantial amount of silicon area compared to all other components, devices, and circuitry of switch 10. Accordingly, being able to keep the area of transistor 12 to a relatively modest level significantly reduces the overall size of a silicon integrated circuit chip in which switch 10 is fabricated and thus reduces cost.

The gate of transistor 12 is coupled to the sources of transistors 14 and 16, to the drain of transistor 60 and to a node 46. The drain of transistor 16 is coupled to an output of operational amplifier 18 and to a node 48. An output terminal of voltage multiplier circuit 24 is coupled to the drain of transistor 14 and to a node 15. The source of transistor 60 is coupled to VSS and to terminal 35. Voltage multiplier circuit 24 and the drain of transistor 12 are coupled to a power supply +VDD and to terminal 11. Transistor 12 has two sources. The first source is coupled to terminal 34, to load 32, to a first terminal of resistor 26, to a first terminal of voltage reference source 28, and to a first (positive) terminal of comparator 20. The second source of transistor 12 is coupled to a second terminal of resistor 26, to a first input (negative) terminal of operational amplifier 18 and to a node 50. A second terminal of voltage reference source 28 is coupled to a second input (positive) terminal of operational amplifier 18 and to a node 52. An output terminal of comparator 20 is coupled to a second input terminal of logic circuit 22 and to a node 54. A first output terminal of logic circuit 22 is coupled to the gate of transistor 60 and to a node 62. A second output terminal of logic circuit 22 is coupled to the gate of transistor 14 and to a node 56. A third output terminal of logic circuit 22 is coupled to the gate of transistor 16 and to a node 58.

Assuming that initially switch 36 is open (in the position shown in FIG. 3) and load 32 has been off for a period of time. The voltage at terminal 34 is essentially zero and the output of comparator 20 is logical "0", typically at or near ground potential. Switch 36 is then closed as is the case if one desires to turn on the head lights of an automobile. In such case switch 36 is typically a hand operated switch located in the cab of an automobile and load 32 is the head light. This results in the output of logic circuit 22 producing a "0", approximately 0 volts, at node 56 and a "1"at node 58, typically above +VDD when +VDD is in the range of +12 to +16 volts (the voltage of an automobile battery). These voltages bias off (disable) transistor 14 and bias on (enable) transistor 16. Operational amplifier 18 generates an output voltage at terminal 48 which is coupled through biased on transistor 16 and which biases on transistor 12. Current starts to flow from +VDD through transistor 12 and load 32 and into VSS. The potential existing on node 50 is compared by operational amplifier 18 with the voltage at node 52. The voltage level of Vref1 is selected to correspond to a desired current level which is to selectively flow through transistor 12 and load 32. The output voltage generated by operational amplifier 18 at node 48 assumes a level which biases on transistor 12 and results in the current flow there through being set to the desired essentially constant level. This level is one at which the power being dissipated by transistor 12 is within the limits that transistor 12 can dissipate without being damaged.

As this essentially constant current flows through transistor 12 and load 32, load 32 heats up and its resistance starts to increase from its "cold" (low) resistance value towards its "hot" (high) resistance value. This increase in resistance causes the potential of node 34 to increase. As soon as the voltage level of node 34 exceeds that of Vref2, comparator 20 causes node 54 to become a "1". Vref2 corresponds to a preselected impedance level. Thus "1's" are applied to terminals 38 and 54 of logic circuit 22. This results in logic circuit 22 generating a "1" on node 56 and a "0" on node 58. These conditions bias on transistor 14 and bias off transistor 16. This couples an output voltage of voltage multiplier circuit 24 to the gate of transistor 12 and isolates the voltage of an output terminal 48 of operational amplifier 18 from the gate of transistor 12. Accordingly, the voltage of the gate of transistor 12 is increased from less than +VDD to about +2VDD. This heavily biases on transistor 12 which reduces its drain-source resistance and thereby allows it to conduct substantially more current. The resistances of transistor 12 and load 32 and the magnitude of the difference between +VDD and VSS determine the current which flows through the series combination of both. Initially there is a relatively large current spike, which is within the limits that can be safely dissipated by transistor 12, and then the current drops to a substantially lower constant level which is a function of the resistance of transistor 12 and the "hot" resistance of load 32.

Figure 1:
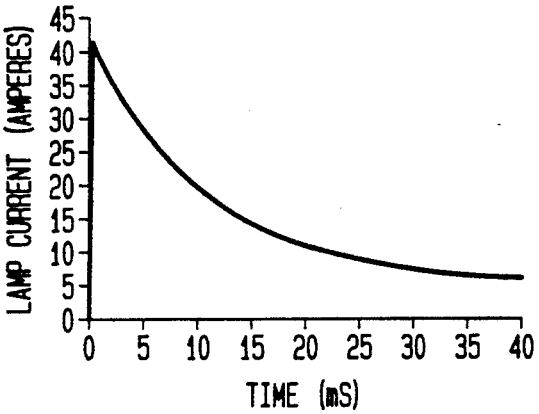
FIG. 1 shows a graph of current through the series combination of a transistor and a lamp versus time for a prior art control circuit.
Figure 2:
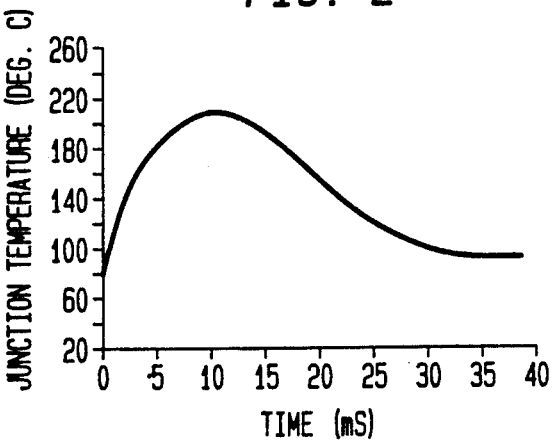
FIG. 2 shows a graph of junction temperature of the transistor of the prior art circuit versus time.
Figure 4:
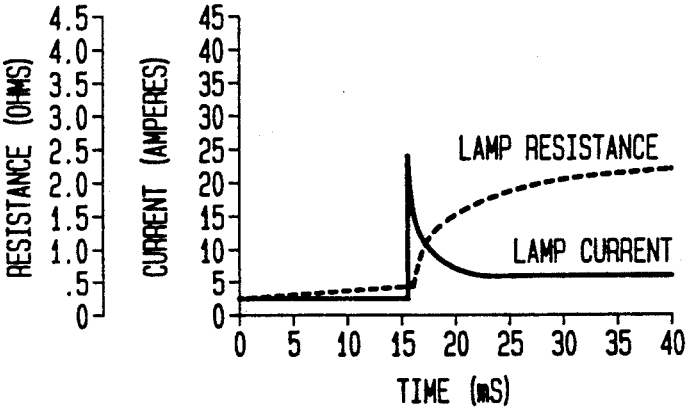
FIG. 4 shows a graph of current through the switch of FIG. 3 versus time.

Referring now to FIG. 4 there is shown a graph of current (the solid line) in amperes and resistance (the dashed line) in ohms on the y-axis versus time (t) in milliseconds (mS) on the x-axis of a typical load 32 such as a automobile head light (a lamp). Between t=0+ and t=16mS the current flow through lamp 32 is essentially constant at about 2 amperes. During this time period the resistance of lamp 32 increases from about 0.2 ohms to about 0.4 ohms. At t=16+mS a spike of current, having a maximum level of about 24 amperes, occurs. This results because the resistance of lamp 32 has increased sufficiently by t=16mS such that the voltage of node 34 is greater than that of Vref2. Thus the gate of transistor 12 is now heavily biased on by voltage multiplier circuit 24 since output terminal 48 of amplifier 18 is isolated from the gate of transistor 12 and this time. Between t=16+mS and t=40mS the current flowing through lamp 32 decreases and reaches a steady state value of about 6 amperes. During this same time the resistance of lamp 32 increases from 0.4 ohms to 2.25 ohms. If when switch 36 is closed the gate of transistor 12 were immediately heavily biased on then the resulting current spike through transistor 12 would be, as is shown in the graph of FIG. 1, 42 amperes which would damage transistor 12.

Figure 5:
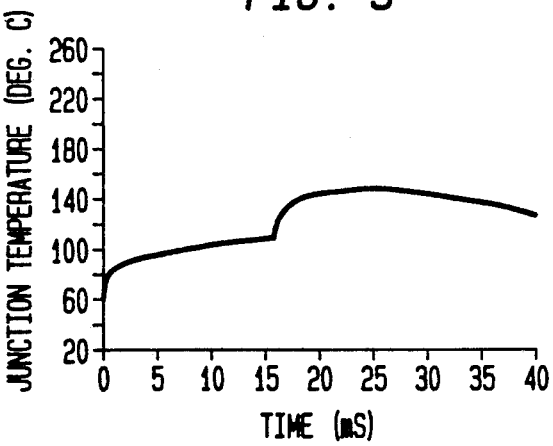
FIG. 5 shows a graph of temperature of a transistor of the switch of FIG. 3 versus time.

Referring now to FIG. 5, there is shown a graph of the junction temperature in degrees C of the transistor 12 on the y-axis versus time (t) in milliseconds (mS) on the x-axis. During t=0+ to t=16+mS the temperature of the junction of transistor 12 increases at a somewhat constant rate to about 110 degrees C. At t=16+mS the temperature rises more rapidly reaching a maximum of approximately +150 degrees C. at about t=25mS. Thereafter the temperature decreases such that at t=40mS it is at about +125 degrees C. It is thus clear that the temperature of transistor 12 essentially is limited to +150 degrees C. and thus there is no damage to transistor 12.

Figure 6:
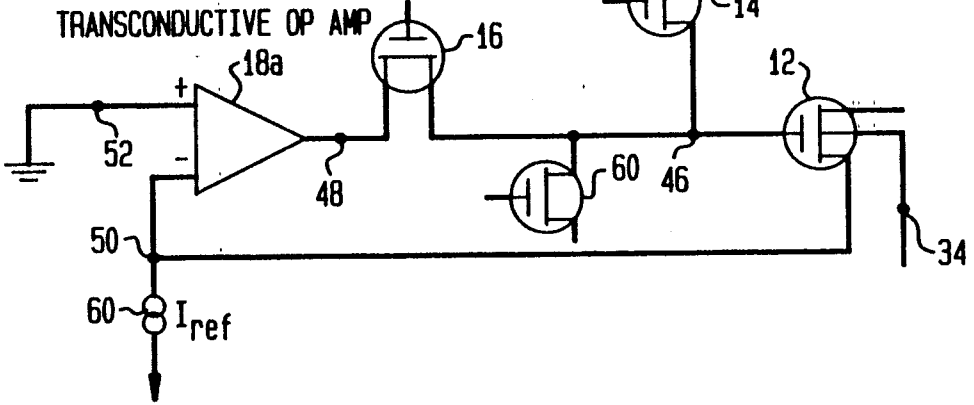
FIG. 6 shows an alternate embodiment of part of the switch of FIG. 3.

Referring now to FIG. 6, there is shown a transconductance operational amplifier 18*a* and constant current source 60 which can be substituted for operational amplifier 18, resistor 26 and voltage source (Vref1) 28 of FIG. 3.

Figure 7:
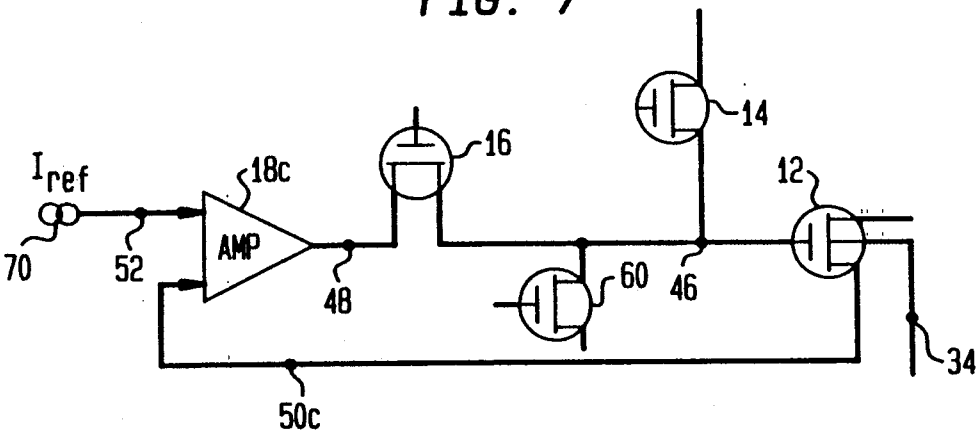
FIG. 7 shows another alternate embodiment of part of the switch of FIG. 3.

Referring now to FIG. 7, there is shown a differential current amplifier 18*c* and a constant current source 70 which can be substituted for the operational amplifier 18, resistor 26 and voltage source (Vref1) 28 of FIG. 3.

Figure 8:
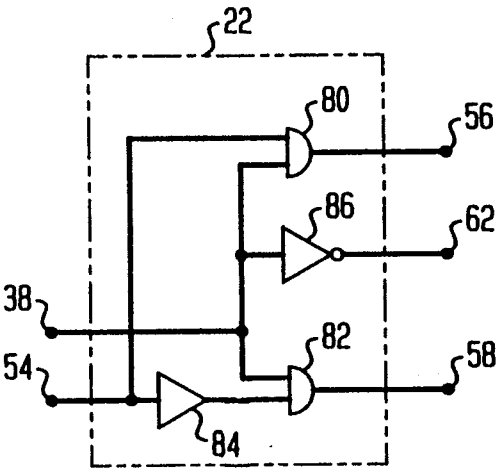
FIG. 8 shows an illustrative embodiment of the logic circuit of FIG. 3.

Referring now to FIG. 8, there is shown illustrative embodiment of logic circuit 22 which comprises two input AND gates 80 and 82 and inverters 84 and 86. If switch 36 of FIG. 3 is open, the equivalent of a "0" is applied to terminal 38. Nodes 56 and 58 are "0's" and node 62 is a "1", independent of the signal level applied to terminal 54. This condition isolates the gate of transistor 12 (node 46) from any source of turn-on bias and thus transistor 12 is disabled and acts as an open circuit between terminals 11 and 34. In addition, it enables (turns-on) transistor 60 which pulls node 46 (the gate of transistor 12) to VSS which disables transistor 12.

If switch 36 is closed then the input signal to terminal 38 is a "1". This disables transistor 60 and allows the potential of node 46 to be changed so that transistor 12 can be biased on. If the input signal to terminal 54 is a "0", then the output signals appearing on nodes 56 and 58 are a "0" and a "1", respectively. This couples the output of operational amplifier 18 to the gate of transistor 12 (node 46) and isolates the output of voltage multiplier circuit 24 from the gate (node 46) of transistor 12. Accordingly, a relatively low magnitude essentially constant current flows through transistor 12 and load 32. If with terminal 38 still being a "1", terminal 54 is switched from a "0" to a "1", then terminals 56 and 58 switch to a "1" and a "0", respectively. This isolates the gate of transistor 12 from the output of amplifier 12 and connects it to the output of voltage multiplier circuit 24. This condition allows transistor 12 to conduct substantially more current from +VDD since its drain-source resistance is at a low value. This point in time corresponds to when the resistance of load 32 has exceeded a preselected level which is represented by the level of Vref2.

Figure 9:
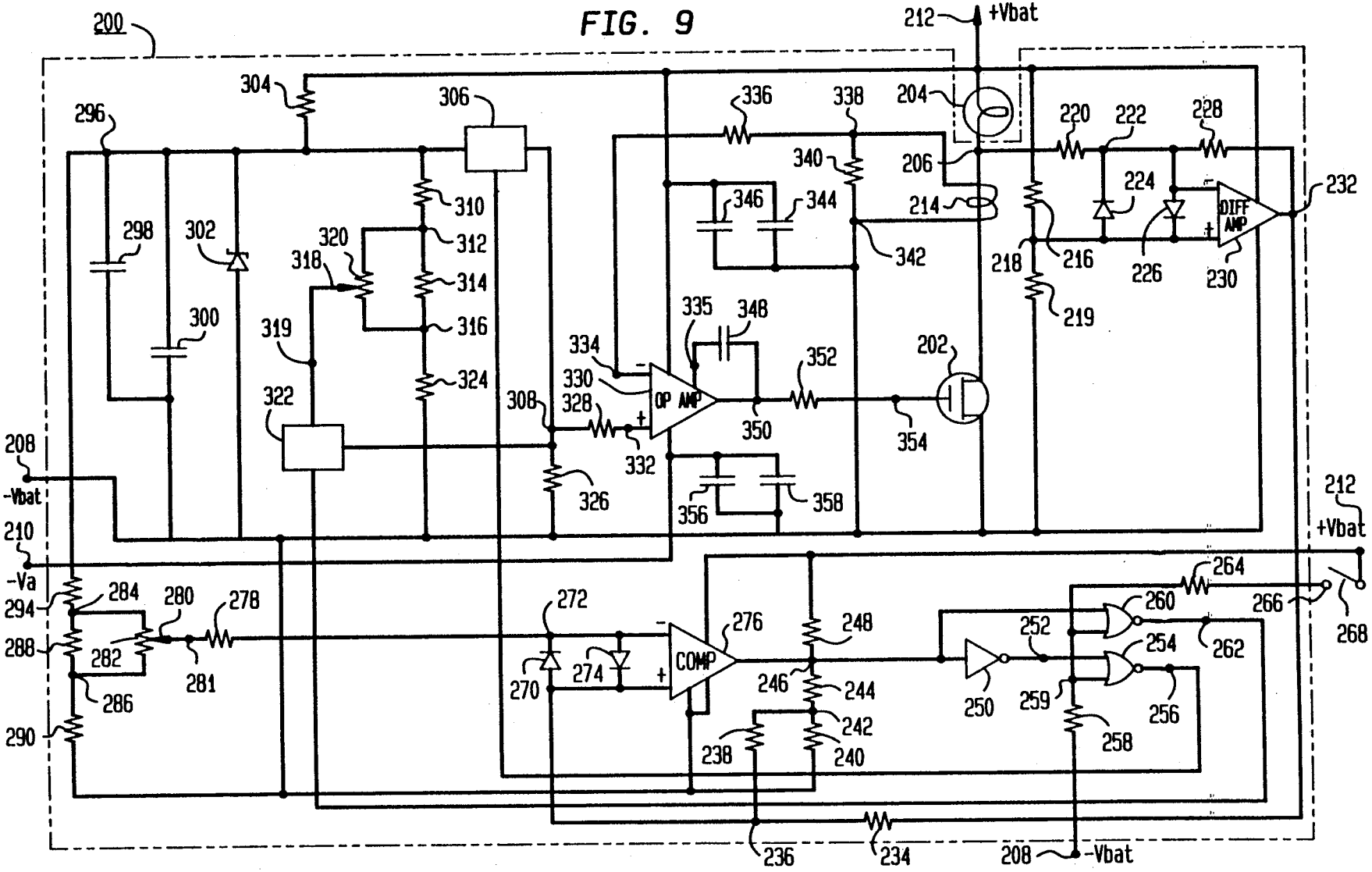
FIG. 9 shows a soft start switch in accordance with another embodiment of the present invention.

Referring now to FIG. 9, there is shown within the dashed line rectangle a soft start switch 200 in accordance with an embodiment of the present invention. Switch 200 comprises an n-channel MOSFET 202, a two input comparator 276, a two input differential amplifier 230, diodes 224, 226, 270 and 274, zener diode 302, power supply by-pass capacitors 298, 300, 344, 346, 356 and 358, potentiometers 282 and 320, capacitor 348, switching devices 306 and 322, current sensing coil (current transformer) 214, and resistors 216, 219, 220, 228, 234, 238, 240, 244, 248, 258, 264, 278, 288, 290, 294, 304, 310, 314, 324, 326, 328, and 352, two input NOR gates 254 and 260 and inverter 250. A lamp 204, (typically the headlight on an automobile) whose turn-on is to be controlled by switch 200, is coupled to positive power supply +Vbat (typically the positive terminal of the automobile battery) and to a terminal 212. A second terminal of lamp 204 is coupled to the drain of MOSFET 202 and to a node 206. The source of transistor 202 is coupled to a negative terminal of the power supply −Vbat 208 (typically the negative terminal of the automobile battery). A switch 268, typically a hand operated switch located in the cab of an automobile, is coupled by one terminal thereof to terminal 212 and to +Vbat and is coupled by a second terminal thereof to a first terminal of resistor 264 and to a terminal 266.

Transistor 202 controls current flow through lamp 202 such that when switch 368 is turned on (the position shown in FIG. 9), transistor 202 is weakly biased on by a source (essentially operational amplifier 330), which causes a relative low preselected essentially constant current to flow through lamp 204 and transistor 202. As will be explained in more detail herein below, the impedance of lamp 404 is monitored as current flows there through and when the impedance of lamp 204 reaches a preselected level, the weak bias applied to gate terminal 354 is cut off and a heavy (full on) bias is applied to terminal 354. The heavy bias facilitates substantial current flow through lamp 204 and transistor 202. As in switch 10 of FIG. 3, a relatively low level of current flow between the lamp (load) and current controlling transistor is used to first heat up the load (lamp) and to therefore cause the impedance (resistance) thereof to increase. As the resistance of the load (lamp) reaches a preselected level, the biasing applied to the gate of the current controlling transistor is significantly increased such that the transistor is fully biased on. A current spike is generated when the transistor is first fully biased on. The magnitude of the current spike is significantly lower than would be the case if the transistor where not first weakly turned on. This reduces cost by allowing the area of the transistor to be significantly smaller than if the transistor had to safely carry a much higher current.

First terminals of each of resistors 216, 248 and 304, operational amplifier 330, lamp 204, comparator 276, two input differential amplifier 230, switch 268 and capacitors 344 and 346 are coupled to terminal 212 and to +Vbat. First terminals of each of capacitors 298, 300, 356, and 358, second terminals of capacitors 344 and 346, first terminals of each of resistors 219, 240, 290, 324, 326, and 340, a second terminal of differential amplifier 230, the source of transistor 202, a first terminal of current sensing coil (current transformer) 206, the anode of zener diode 302, and second and third terminals of comparator 276 are coupled to a terminal 208 and to −Vbat. A second terminal of operational amplifier 330 and second terminals of capacitors 356 and 358 are coupled to a terminal 210 and to power supply −Va.

A second terminal of lamp 204 is coupled to the drain (second output terminal) of transistor 202, to a first terminal of resistor 220 and to a node 206. Current sensing coil 214 is wrapped around the wire (no reference numbers shown) which couples the second terminal of lamp 204 to the drain of transistor 202. A second terminal of current sensing coil 214 is coupled to a second terminal of resistor 340, to a first terminal of resistor 336 and to a node 338. A second terminal of resistor 336 is coupled to a first input terminal (the negative input terminal) of operational amplifier 330 and to a node 334. A second terminal of operational amplifier 330 is coupled to a first terminal of capacitor 348 and to a terminal 335. A second terminal of capacitor 348 is coupled to an output terminal of operational amplifier 330, to a first terminal of resistor 352, and to a node 350. A second terminal of resistor 352 is coupled to the gate of transistor 202 and to a node 354. A second terminal of each of resistors 216 and 219 are coupled to a node 218, to the anode of diode 224, to the cathode of diode 226, to a positive first input terminal of differential amplifier 230 and to a node 218. A second terminal of resistor 220 is coupled to the cathode of diode 224, to the anode of diode 226, to a first terminal of resistor 228 to a second negative input terminal of differential amplifier 230 and to a node 222. A second terminal of resistor 228 is coupled to an output terminal of differential amplifier 230, to a first terminal of resistor 234, and to a node 232. A second terminal of resistor 234 is coupled to a first terminal of resistor 238, to the anode of diode 270, to the cathode of diode 274, to a first positive input terminal of comparator 276 and to a node 236.

A second terminal of switch 268 is coupled to a first terminal of resistor 264 and to a node 266. A second terminal of resistor 264 is coupled to first input terminals of NOR gates 254 and 260, a second terminal of resistor 258 and to a node 259. A second terminal of resistor 248 is coupled to an output terminal of comparator 276, to a first terminal of resistor 244, to a first input terminal of inverter 250, to a second input terminal of NOR gate 260 and to a terminal 246. A second terminal of resistor 244 is coupled to a second terminal of resistor 238, to a first terminal of resistor 240 and to a node 242. An output terminal of inverter 250 is coupled to a second input terminal of NOR gate 254 and to a node 252. An output terminal of NOR gate 260 is coupled to a control terminal of switch 322 and to a node 262. An output terminal of NOR gate 254 is coupled to a control terminal of switch 306 and to a node 256. A first terminal of resistor 278 is coupled to the cathode of diode 270, to the anode of diode 274, to a second (negative) input terminals of comparator 276 and to a node 272. A second terminal of resistor 278 is coupled to the wiper arm of potentiometer 282 and to node 281. A first terminal of potentiometer 286 is coupled to a first terminals of resistors 288 and 294 and to node 284. A second terminal of resistor 288 is coupled to a second terminal of potentiometer 282, to a second terminal of resistor 290 and to a node 286. A second terminal of resistor 294 is coupled to second terminals of capacitors 298 and 300, the cathode of zener diode 302, a second terminal of resistor 304, a first terminal of resistor 310, a first output terminal of switch 306 and to a node 296. Second output terminals of switches 306 and 322 are coupled to a first terminal of resistor 328, a second terminal of resistor 326 and to a node 308. A second terminal of resistor 328 is coupled to a second (positive) input terminal of operational amplifier 330 and to a node 332. A first output terminal of switch 332 is coupled to a wiper arm 318 of a potentiometer 320 and to a node 319. A first terminal of potentiometer 320 is coupled to a second terminal of resistor 310, to a first terminal of resistor 314 and to a node 312. A second terminal of resistor 314 is coupled to a second terminal of resistor 324, to a second terminal of potentiometer 320 and to a node 316.

Switch 268 is shown with its wiper arm (no number shown) open such that terminals 212 and 268 are isolated from each other. This is the position of switch 266 which is used to turn on lamp 204. Switches 306 and 322 are each typically an analog switch such as the Motorola MC14016 which comprises a pair of complementary MOS transistors and an inverter. The input terminal (node 256) switch 306 is coupled to the gate of the n-channel transistor and an input terminal of the inverter of switch 306. The output of the inverter is coupled to the gate of the p-channel transistor. The drain of the n-channel transistor and the source of the p-channel transistor are coupled to node 296. The source of the n-channel transistor and the drain of the p-channel are coupled to node 308. The transistors and inverter of switch 322 are connected essentially in the same way as the corresponding components of switch 306 but are coupled to nodes 256, 319, and 308.

Assume that switch 268 is in the turned on position which is as is shown in FIG. 9. In this position switch 200 acts to allow current to flow through lamp 204 and transistor 202 by, as will be clear from the below description, first weakly biasing the gate (node 354) of transistor 202 on to establish a relatively low constant current flow through lamp 204 and transistor 202 and then, after the resistance of lamp 204 reaches a preselected level, strongly biasing the gate of transistor 202 on so as to allow a substantially higher current flow through lamp 204 and transistor 202. The combination of resistors 216, 219, 220, 228, and 234 and differential amplifier 230 serve to compare the voltage at node 206 with the voltage at node 218 and to provide at terminal 236 twice the difference. Diodes 224 and 226 serve to clamp to voltages on nodes 218 and 222 to within approximately 0.8 volts of each other. The voltage level appearing on node 236 serves as one input to the positive input terminal (node 236) of comparator 276. A voltage divider network consisting of resistors 304, 294, 288, potentiometer 282 and resistor 290 serves to generate a reference voltage, which corresponds to a preselected resistance of lamp 204, that appears at the negative input terminal (node 272) of comparator 276. If the voltage of node 236 is less than that of node 272 then the output of comparator 276 (node 246) is a "0". Since the first input terminals of NOR gates 254 and 260 are at logical "0's" (a level of −Vbat which is typically ground potential), and the second input terminal of NOR gate 260 is a "0", the output (node 262) of NOR gate 260 is a "1". Inverter 250 inverts the "0"output of comparator 276 and thus applies a "1" to the second input terminal of NOR gate (node 256) being a "1". A "1" and a "0" applied to the control terminals (nodes 256 and 262) of switches 322 and 306, respectively, cause switch 322 to couple node 319 to node 308 and cause switch 306 to isolate node 296 from node 308. Node 319 is at a lower voltage level than node 296. Accordingly the lower voltage level of node 319 is coupled to node 308. After some voltage drop due to resistor 328, the voltage of node 328 is applied to the positive input terminal (node 332) of operational amplifier 330.

If the voltage appearing at node 236 is greater than that appearing at node 272, (this corresponds to a condition in which the resistance of lamp 204 is greater than the preselected resistance), then the output of comparator 276 is a "1" and the outputs of NOR gates 254 and 260 are a "1" and a "0" respectively. This couples node 296 to node 308 and isolates node 319 from node 308. Thus under these conditions the higher voltage of node 296 controls the voltage of node 308 and consequently node 332 (the positive input terminal of operational amplifier 330).

The combination of current sensing coil (transformer) 216 and resistors 340 and 336 serve to sense the amount of current flow through lamp 204 and transistor 202 and to generate a voltage at node 334 (the negative input terminal of operational amplifier 330) which corresponds to this current level. Operational amplifier 330 compares the voltage levels applied to its input terminals (nodes 332 and 334) and to generate a bias level at the output terminal thereof (node 350) which causes a relatively weak bias to be applied to the gate (node 354) of transistor 202 if switch 322 is on (node 319 is coupled to node 308) or causes a relatively heavily bias to be applied to the gate (node 296 is coupled to node 308) if switch 306 is on. In either case the feedback loop containing sensing coil 214 and operational amplifier 330 attempts to control a relatively constant current flow through lamp 204 and transistor 202.

Figure 10:
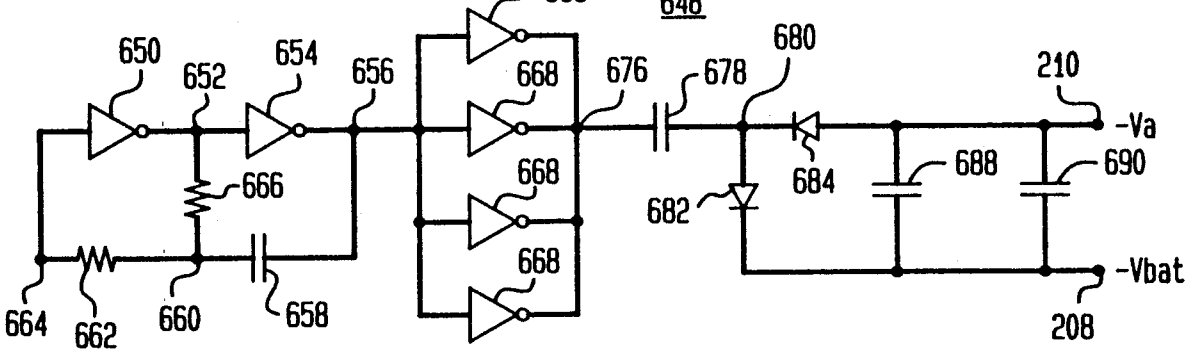
FIG. 10 shows a negative voltage generator which can be used with the switch of FIG. 9.

Referring now to FIG. 10, there is shown a negative voltage generator 648 which comprises inverters 650 and 654, a plurality of inverters 668, resistors 662 and 666, capacitors 658, 678, 688 and 690 and diodes 682 and 684. Inverters 668 serve essentially as a driver which has the desired drive capability. The combination of inverters 650 and 654, resistors 662 and 666 and capacitor 658 serves essentially as an oscillator. All the inverters are powered by connecting same between +Vbat and −Vbat of FIG. 9. Capacitor 678 serves as an ac couple. Diodes 682 and 684 serve as rectifiers with capacitors 688 and 690 serving as filters. The output voltage −Va generated at node 686 is a negative voltage having a magnitude approximately equal to that of +Vbat less about 1.6 volts. With +Vbat=+12 volts, −Va=−10.4 volts. Negative voltage generator 648 is useful to generate to −Va used to power operational amplifier 330 of FIG. 9.

Figure 11:
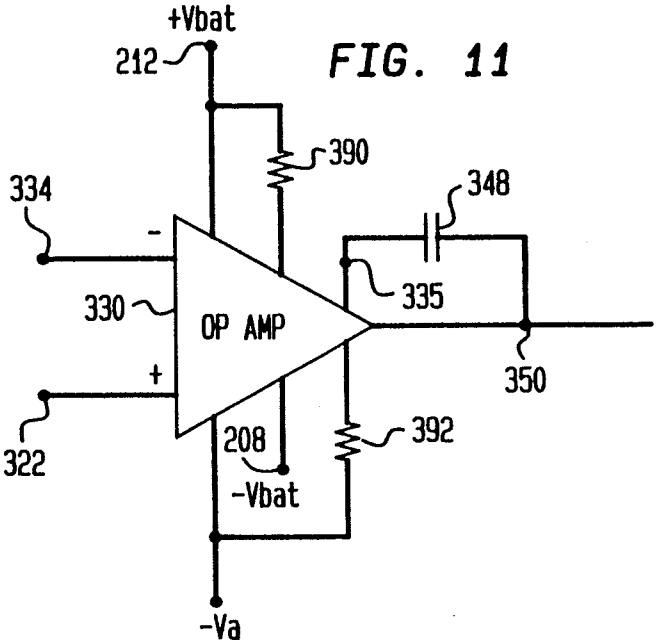
FIG. 11 shows an operational amplifier useful as a component of the switch of FIG. 9.

Referring now to FIG. 11, there is shown a typical embodiment of operational amplifier 330 of FIG. 9. The resistors shown (resistors 390 and 392) are used to set the gain of amplifier 330 and are not shown in FIG. 9.

Figure 12:
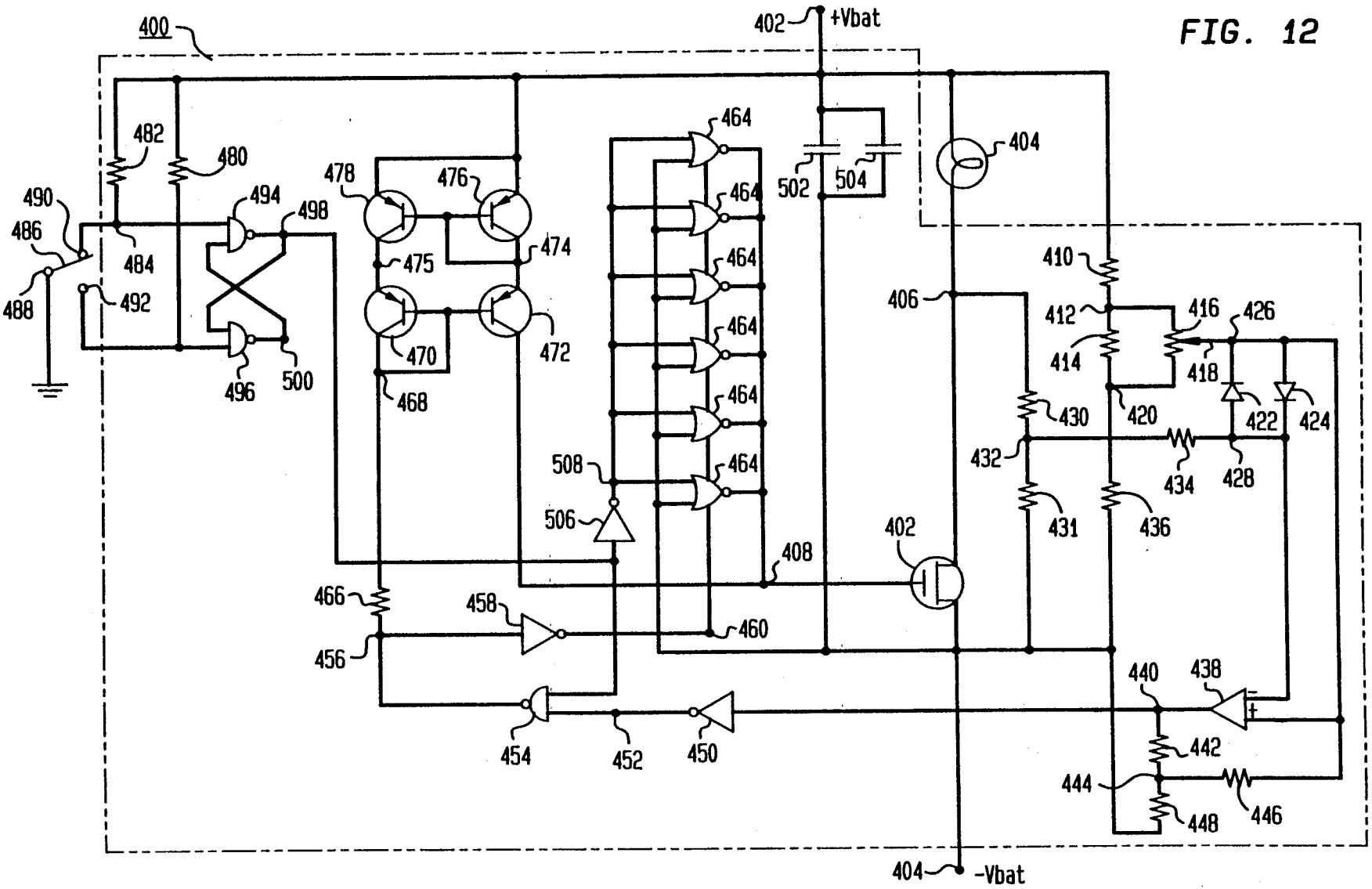
FIG. 12 shows a soft start solid state switch in accordance with still another embodiment of the present invention.

Referring now to FIG. 12, there is shown within the dashed line rectangle a soft start solid state switch 400 in accordance with an embodiment of the present invention. Switch 400 comprises an n-channel MOSFET 402, a two input comparator 438, a plurality of clocked two input NOR gates 464, inverters 450, 458, and 506, NAND gates 454, 494 and 496, p-n-p bipolar transistors 470, 472, 474 and 478, diodes 422 and 424, resistors 410, 414, 430, 431, 434, 436, 446 and 448, potentiometer 418 and to by-pass capacitors 502 and 504. A positive terminal +Vbat 402 of a power supply, typically the battery of an automobile, is coupled to a first terminal of a lamp 404 (typically a head light of an automobile), to first terminals of resistors 410, 480, and 482, to the emitters of transistors 476 and 478 and to first terminals of capacitors 502 and 504. A negative terminal −Vbat 404 of the power supply is coupled to the source of transistor 402 to first terminals of resistors 431, 436 and 448, to each of first input terminals of clocked NOR gates 464 and to second terminals of capacitors 502 and 504. Clocked NOR gates 464 effectively act as clocked inverters. The use of a plurality of gates 464 is for obtaining the required drive capability to heavily bias on transistor 402. A switch 468, typically a hand operated switch located in the cab of the automobile, has a first terminal coupled to a first input terminal of switch 400 and to a node 484, and has a second terminal 448 coupled to ground potential which is typically the same as −Vbat.

Transistor 402 controls current flow through lamp 404 such that when switch 486 is turned on (the position shown in FIG. 12), transistor 402 is weakly biased on by an essentially constant current supply to gate terminal 408 by a constant current source comprising transistors 470, 472, 476 and 478. As will be explained herein below, the resistance of lamp 404 is monitored as current flows there through. When the impedance level of lamp 404 reaches a preselected level, the weak essentially constant current biasing applied to gate terminal 408 is cut off and heavily (full on) biasing is applied by clocked (gated) NOR gates 464 to gate terminal 408. The control of current flow through transistor 402 and lamp 404 is very similar to the corresponding control of current flow through transistor 12 and load 32 of FIG. 3 except that an essentially constant current source which selectively weakly biases transistor 402 on and allows a continuing build up of current flow through transistor 402 and lamp 404 is substituted for the essentially constant generator current source of FIG. 1 which selectively biases the gate of transistor 12 so as to generate a relatively low level constant current flow through transistor 12 and load 32. In both embodiments a relatively low level of current flow between the load (lamp) and current controlling transistor is used to first heat up the load (lamp) and to therefore cause the impedance (resistance) thereof to increase. As the resistance of the load (lamp) reaches a preselected level, the biasing applied to the current controlling transistor is significantly increased such that the transistor is fully biased on. A current spike is generated when the transistor is fully biased on. The magnitude of the current spike is significantly lower than would be the case if the transistor where not first weakly turned on. This reduces cost since it allows for the area of the transistor to be significantly smaller than if the transistor had to safely carry a much higher current.

A second terminal lamp 404 is coupled to the drain of transistor 402, to a first terminal of resistor 430 and to a node 406. A second terminal of resistor 430 is coupled to a first terminal of resistor 434, to a second terminal of resistor 431 and to a node 432. A second terminal of resistor 410 is coupled to a first terminal of resistor 414 and to a first terminal of potentiometer 416 and to a terminal 412. A second terminal of resistor 414 is coupled to a second terminal of resistor 436, to a second terminal of potentiometer 418 and to a node 420. A wiper member 418 of potentiometer 416 is coupled to the cathode of diode 422, to the anode of diode 424, to a first (positive) input terminal of comparator 438, to a first terminal of resistor 446 and to a node 426. A second terminal of resistor 434 is coupled to the anode of diode 422, to the cathode of diode 424, to a second (negative) input terminal of comparator 438 and to a node 428. An output terminal of comparator 438 is coupled to a first terminal of resistor 422, to an input terminal of a inverter 450 and to a node 440. Second output terminals of resistors 442, 446 and 448 are coupled to node 444. An output terminal of inverter 450 is coupled to a first input terminal of NAND gate 454 and to a node 452. An output terminal of NAND gate 454 is coupled to an input terminal of inverter 458, to a first terminal of resistor 466 and to a node 456. An output terminal of inverter 458 is coupled to control terminal of NOR gates 464 and to a node 460. A second output terminal of resistor 466 is coupled to the bases of transistors 470 and 472, to the collector of transistor 470 and to a node 468. The collector of transistor 472 is coupled to the output terminals of clocked NOR gates 464, to the gate of transistor 402 and to a node 408. The emitter of transistor 472 is coupled to the collector of transistor 476, to the bases of transistors 476 and 478 and to a node 474. The emitter of transistor 470 is coupled to the collector of transistor 478 and to a node 475.

A first input terminal of switch 400 is coupled to a second terminal of resistor 482, to a first input terminal of and gate 494, to a first terminal of switch 486 and to a node 484. A second input terminal 492 of switch 400 is coupled to a second terminal of resistor 480 and to a first input terminal of NAND gate 496. A second input terminal of gate 494 is coupled to an output terminal of gate 496 and to a node 500. A second input terminal of gate 496 is coupled to an output terminal of gate 494, to a second input terminal of NAND gate 454, to an input terminal of inverter 506 and to a node 498. An output terminal of inverter 506 is coupled to second input terminal of gates 464 and to a node 508.

NAND gates 494 and 496 are cross-coupled to form a flip-flop circuit. This helps limit bounce by switch 486. With switch 486 in the closed position, with the wiper arm contacting node 484, the output at node 498 is a "1". This "1" is coupled to the input terminal of inverter 506 and to one input terminal of NAND gate 454.

Inverter 506 inverts the "1" input signal and thus a "0" is applied to the second input terminals of gated NOR gates 464. Assume that a "1" signal exists at this time on node 460. Gates 464 are thus gated off and the outputs appear as a high impedance. Thus the gate 408 of transistor 402 is essentially isolated from gates 464 at this time. A "1" at node 460 corresponds to a "0" at node 456 since inverter 458 couples these two nodes. With a "0" at node 456, current flows from +Vbat through transistors 478 and 470. This current flow is mirrored through transistors 476 and 472 and flows into the gate (node 408) of transistor 402 and weakly biases it on. Thus current begins to flow form +Vbat, through lamp 404 and transistor 402 and returns to −Vbat. Transistors amount of current into the gate of transistor 402 which increases the voltage of node 408 and thus increases the on bias of transistor 402. This increases the current flow through lamp 404 and transistor 402. As current flows through lamp 404, its resistance rises from a "cold" low level to a "hot" higher level. The combination of resistors 410, 414, 436, 442, 446 and 448 and potentiometer 416 set up a reference voltage at node 426 (the positive input terminal of comparator 438) which corresponds to a preselected resistance level. The combination of resistors 430, 431 and 434 sets up a voltage at node 428 (the negative input terminal of comparator 438}which corresponds to the resistance of lamp 404.

Assume lamp 404 has been off and that switch 486 is then closed so as to turn on lamp 404. As current flows through lamp 404 its resistance increases and correspondingly the voltage of the negative input terminal of comparator 438 (node 428) increases relative to positive input terminal (node 426) of comparator 438. While node 428 is at a lower or the same voltage as node 426, the output terminal (node 440) of comparator 438 is a logical "0". This "0" is inverted by inverter 450 and thus a "1" appears at node 452 (the second input terminal of NAND gate 454). Since, as has been discussed earlier herein above, with switch 486 closed (as is shown) a "1" is applied to the first input terminal (node 498) of NAND gate 454. The result of the two "1" input signals to NAND gate 454 is an output "0"signal at node 456 when switch 486 is first closed to turn-on lamp 404.

As current continues to flow through lamp 404 and the level of current increased, the voltage of node 428 increases until it exceeds the voltage of node 426. At the time the output signal at node 440 of comparator 438 switches from a "0" to a "1". This causes the second input terminal of NAND gate 454 to be a "0" which results in the output terminal of NAND gate 454 becoming a "1". The "1" potential level is at approximately +Vbat. Accordingly, current flow through transistors 470 and 478 causes corresponding current flow through transistors 476 and 472 which flows into the gate (node 408) of transistor 402. This results in current flow through lamp 404 and transistor 402 which turns on lamp 404. As current flows through lamp 404 its resistance increases and correspondingly the voltage of the negative input terminal of comparator 438 (node 428) increases relative to positive input terminal (node 426) of comparator 438. While node 428 is at a lower or the same voltage as node 426, the output of terminal (node 440) comparator 438 is a logical "0". This "0" is inverted by inverter 450 and thus a "1" appears at node 452 (the second input terminal of NAND gate 454). Since, as has been discussed earlier herein above, with switch 486 closed (as is shown), a "1" is applied to the first input terminal (node 462) of NAND gate 454. The result of the two "1" input signals to NAND gate 454 is an output "0" signal at node 456 when switch 486 is first close to turn-on lamp 404.

As current continues to flow through lamp 404 and the level of current increased, the voltage of node 428 increases until it exceeds the voltage of node 426. At the time the output signal of comparator 438 switches from a "0" to a "1". This causes the second input terminal of NAND gate 454 to be a "0" which results in the output terminal of NAND gate 454 becoming a "1". The "1" voltage level is at approximately +Vbat. Accordingly, current flow through transistors 470 and 478 ceases. This cuts off current flow through transistors 476 and 472 into the gate (node 408) of transistor 402. The "1" on node 456 is inverted by inverter 458 and thus a "0" exists on node 460 and gates 464 are clocked on. As discussed earlier herein above, gates 464 essentially act as clocked inverters since all the second input terminals are coupled to −Vbat. Gates 464 invert the "0" input signal at each first input terminal (node 508) thereof and generate a "1" at node 408 (the gate of transistor 402). This heavily biases on transistor 402 which results in an initial current spike which then dissipates with increasing time to a steady state current flow through lamp 404 and transistor 402.

It is to be understood that the specific designs describe exemplary embodiments which are merely illustrative of the spirit and scope of the invention. Modifications can be made in the specific design consistent within the principles of the invention. For example, the n-channel transistor used to control current through the lamp could be a p-channel transistor or an n-p-n or p-n-p bipolar transistor providing the correct polarity power supply and appropriate biasing is used. Still further, other appropriated voltage and current sensing circuits could be used as could a variety of comparing circuits and amplifiers. Furthermore, the novel switches of the present invention can be used to control a motor with a viscous or inverted load or a solenoid.

What is claimed is:

1. Circuitry connectable to a load whose impedance nonlinearly increases during turn-on, said circuitry comprising:

a device having a control terminal and first and second output terminals and being adapted such that current flow from one output terminal to the other output terminal through the device can be controlled by bias applied to the control terminal;

first biasing means selectively coupled to the control terminal of the device for selectively biasing on the device such that current flows through the device;

second biasing means selectively coupled to the control terminal of the device for selectively biasing the device to allow current flow there through which is greater than that permitted by the first biasing means; and detecting and coupling/decoupling means coupled to the second output terminal of the device for effectively detecting the impedance of the load and for coupling the first biasing means or the second biasing means to bias on the device while decoupling the other such that when the impedance of the load is at or below a preselected level, the first biasing means controls current flow through the device, and when the impedance of the load is above the preselected level, the second biasing means controls current flow through the device.

2. The circuitry of claim 1 wherein the device is a field effect transistor (FET).

3. The circuitry of claim 2 wherein the device is an n-channel Metal-Oxide-silicon (MOS) FET, a MOSFET.

4. The circuitry of claim 3 wherein the MOSFET has at least first and second sources.

5. The circuitry of claim 4 wherein the first biasing means is coupled to the first and second sources and to the gate of the MOSFET.

6. The circuitry of claim 5 wherein:

the first biasing means comprises a resistor, an operational amplifier, and a means for establishing a first reference voltage;

a first terminal of the resistor being coupled to a first input terminal of the amplifier and to the first source of the MOSFET;

a second terminal of the resistor being coupled to the second source of the MOSFET;

the means for establishing a first reference voltage is coupled to a second input terminal of the amplifier; and and output terminal of the amplifier is coupled to the gate of the MOSFET.

7. The circuitry of claim 6 wherein the second biasing means comprises a voltage multiplier circuit.

8. The circuitry of claim 4 wherein: the detecting and coupling/decoupling means comprises a comparator coupled by a first input terminal to the second source of the MOSFET; and coupled by a second input terminal to a second reference voltage which corresponds to a preselected value of impedance of the load; of logic circuit and first and second coupling/decoupling devices;

the first and second coupling/decoupling devices each having a control terminal and first and second output terminals;

an output terminal of the comparator being coupled to the logic circuit;

a first output terminal of the logic circuit being coupled to the control terminal of the first coupling-/decoupling means;

a second output terminal of the logic circuit being coupled to the control terminal of the second coupling/decoupling devices;

the first and second output terminals of the first coupling/decoupling devices being coupled to the output terminal of the amplifier and to the gate of the MOSFET, respectively; and the first and second output terminals of the second coupler/decoupler device being coupled to the second biasing means and to the gate of MOSFET, respectively.

9. The circuitry of claim 8 wherein the logic circuit includes means for enabling same, and output means for biasing on the first coupling/decoupling device while biasing off the second coupling/decoupling device when the impedance of the load is at or below the preselected level and for, biasing on the second coupling-/decoupling device while biasing off the first coupling-/decoupling device when the impedance of the load is greater than the preselected impedance level.

10. Circuitry connectable to a load whose impedance nonlinearly increases during turn-on, said circuitry comprising:

a device having a control terminal and first and second output terminals and being adapted such that current flow from one output terminal to the other output terminal through the device can be controlled by bias applied to the control terminal;

an essentially constant current generating means selectively coupled to the control terminal of the device for selectively biasing on the device such that a preselected essentially constant current flows through the device;

biasing means selectively coupled to the control terminal of the device for selectively biasing the device to allow current flow there through which is greater than the constant current flow; and detecting and coupling/decoupling means coupled to the second output terminal of the device for effectively detecting the impedance of the load and for coupling the constant current means or the biasing means to bias on the device while decoupling the other such that when the impedance of the load is at or below a preselected level, the constant current generating means controls current flow through the device, and when the impedance of the load is above the preselected level, the biasing means controls current flow through the device.

11. Circuitry connectable to a load whose impedance nonlinearly increases during turn-on, said circuitry comprising:

a device having a control terminal and first and second output terminals and being adapted such that current flow from one output terminal to the other output terminal through the device can be controlled by bias applied to the control terminal;

constant current biasing means selectively coupled to the control terminal of the device for selectively biasing on the device with a flow of essentially constant current into the control terminal such that the bias of the control terminal of the device increases with time;

heavy biasing means selectively coupled to the control terminal of the device for selectively more heavily biasing on the device than the constant current biasing means; and detecting and coupling/decoupling means coupled to the second output terminal of the device for effectively detecting the impedance of the load and for coupling the constant current biasing means or the heavy biasing means to bias on the device while decoupling the other such that when the impedance of the load is at or below a preselected level, the constant current means controls current flow through the device, and when the impedance of the load is above the preselected level, the heavy biasing means controls current flow through the device.

12. Current control means for controlling current flow through a load whose impedance is nonlinear during turn on comprising:

a device having a control terminal and first and second output terminals and being adapted such that current flow from one output terminal to the other output terminal through the device can be controlled by signals applied to the control terminal;

current detection means for detecting current flow through the device;

a reference level indicative of a desired flow of current through the device;

first comparing and generating means for comparing current flow through the device with the reference level of current and for generating a signal which is selectively coupled to the control terminal of the device and which modifies current flow through the device such that the current flow through the device is essentially equal to the reference level;

the second output terminal of the device being connectable to the load;

means for detecting voltage at the second output terminal of the device;

a reference voltage indicative of a preselected level of impedance of the load;

a second comparing means for comparing the voltage of the second output terminal of the device with the reference voltage and for generating a first output signal if the voltage at the second output terminal of the device is greater than the reference voltage and for generating a second different output signal if the voltage and the second output terminal of the device is equal to or less than the reference voltage;

a voltage generator circuit;

first and second switching devices each having a control terminal and first and second output terminals;

the second output terminals of the first and second switching devices being coupled to the control terminal of the device;

the first output terminal of the first switching device being coupled to an output terminal of the voltage generator circuit;

the first output terminal of the second switching device being coupled to an output terminal of the first comparing means; and logic circuitry coupled to an output terminal of the second comparing means and to the control terminals of the first and second switching devices, said logic circuitry being adapted to cause the second switching means to be enabled so as to couple the first comparing and generating means for comparing if the voltage at the second output terminal of the device is equal to or less than the reference potential and for causing the first switching device to isolate the voltage generator circuit from the control terminal of the device if the voltage of the second output terminal of the device is less than or equal to the reference voltage, and to selectively couple and isolate the voltage generator circuit and the first comparing means, respectively, to the control terminal of the device if the voltage of the second output terminal of the device is greater than the reference voltage.

13. Circuitry connectable to a load whose resistance nonlinearly increases during turn-on, said circuitry comprising:

a transistor having a control terminal and first and second output terminals, the second output terminal being connectable to the load;

first biasing means selectively coupled to the control terminal of the transistor for selectively enabling the transistor so as to facilitate current flow through the transistor and the load;

second biasing means selectively coupled to the control terminal of the transistor for selectively enabling the transistor so as to facilitate current flow through the transistor and the load with the magnitude of such current flow being greater than resulting from the first biasing means; and resistance detecting and coupling/decoupling means connectable to the load and being coupled to the first and second biasing means effectively detecting the resistance of the load and for coupling the first biasing means or the second biasing means to the control terminal of the transistor while decoupling the other such that when the resistance of the load is at or below a preselected level, the first biasing means is coupled to the control terminal of the transistor, and when the resistance of the load is above the preselected level, the second biasing means is coupled to the control terminal of the transistor.

14. Circuitry connectable to a load whose resistance nonlinearly increases during turn-on, said circuitry comprising:

a transistor haVing a control terminal and first and second output terminals, the second output terminal being connectable to the load;

first biasing means selectively coupled to the control terminal of the transistor for selectively enabling the transistor so as to facilitate current floW through the transistor and the load;

second biasing means selectively coupled to the control terminal of the transistor for selectively enabling the transistor so as to facilitate current flow through the transistor and the load with the magnitude of such current flow being greater than resulting from the first biasing means;

resistance detecting means connectable to the load for detecting the resistance of the load;

a comparator having a first input terminal connectable to a reference level corresponding to a preselected resistance value and having a second input terminal coupled to the resistance detecting means, for comparing the resistance of the load to the reference value and for generating a first signal at an output terminal thereof if the value of the load resistance is less than or equal to the reference level and for generating a second different signal if the value of the load resistance is greater than the reference level;

first and second coupling/decoupling means for selectively coupling or decoupling the first and second bias means to the control terminal of the transistor;

a logic circuit coupled by an input terminal to the output terminal of the comparator and coupled by first and second output terminals thereof to a control terminal of the first coupling/decouplng means and to a control terminal of the second coupling means, respectively; and the logic circuit being adapted to cause the first coupling/decoupling to couple the first biasing means to the control terminal of the transistor and to cause the second coupling/decoupling means to isolate (decouple) the second biasing means from the control terminal of the transistor if the resistance of the load is equal to or less than the reference level, and to couple the second biasing means to the control terminal transistor and to isolate the first biasing means from the control terminal of the transistor if the load resistance is greater than the reference level.

15. The circuitry of claim 14 wherein the transistor is a field effect transistor.

16. The circuitry of claim 15 wherein the field effect transistor is an n-channel Metal-Oxide-Semiconductor (MOS) transistor.

17. The circuitry of claim 16 wherein the first and second coupling/decoupling means each comprise at least one MOS transistor.

18. The circuitry of claim 16 wherein the load is an incandescent lamp.

19. In combination:

a load being characterized by a nonlinear impedance during turn-on;

a power supply having output terminals;

a device having a control terminal and first and second output terminals and being adapted such that current flow from one output terminal to the other output terminal through the device can be controlled by bias applied to the control terminal;

a first terminal of the load being coupled to the second output terminal of the device and one of the output terminals of the power supply being coupled to the first output terminal of the device and another output terminal of the power supply being coupled to a second terminal of the load;

first biasing means selectively coupled to the control terminal of the device for selectively biasing on the device such that current flows through the device and the load;

second biasing means selectively coupled to the control terminal of the device for selectively biasing the device such that current flows through the device and the load with the level of current flow being greater than caused by the first biasing means;; and detecting and coupling/decoupling means coupled to the second output terminal of the device for effectively detecting the impedance of the load and for coupling the first biasing means or the second biasing means to bias on the device while decoupling the other such that when the impedance of the load is at or below a preselected level, the first biasing means controls current flow through the device, and when the impedance of the load is above the preselected level, the second biasing means controls current flow through the device.

20. The combination of claim 19 wherein the device is an n-channel Metal-Oxide-Semiconductor (MOS) field effect transistor and the load is an incandescent lamp.

* * * * *